US010898021B2

(12) United States Patent
Rampton

(10) Patent No.: US 10,898,021 B2
(45) Date of Patent: Jan. 26, 2021

(54) PACKAGE CONTAINER

(71) Applicant: Ryan Rampton, Syracuse, UT (US)

(72) Inventor: Ryan Rampton, Syracuse, UT (US)

( * ) Notice: Subject to any disclaimer, the term of this patent is extended or adjusted under 35 U.S.C. 154(b) by 0 days.

(21) Appl. No.: 16/259,981

(22) Filed: Jan. 28, 2019

(65) Prior Publication Data

US 2019/0231107 A1 Aug. 1, 2019

Related U.S. Application Data

(60) Provisional application No. 62/622,369, filed on Jan. 26, 2018.

(51) Int. Cl.
*A47G 29/14* (2006.01)

(52) U.S. Cl.
CPC ..... *A47G 29/141* (2013.01); *A47G 2029/145* (2013.01); *A47G 2200/22* (2013.01)

(58) Field of Classification Search
CPC ..... A47G 29/141; A47G 29/1216; A47G 2029/145; A47G 2200/22; A47G 29/20; B65F 1/08; B65F 1/14; B65F 1/141
USPC ..... 232/39; 220/908, 603; 248/364
See application file for complete search history.

(56) References Cited

U.S. PATENT DOCUMENTS 2,545,320 A * 3/1951 Tilson ..... B65F 1/141 248/346.03
2,916,184 A * 12/1959 Hartley ..... B60R 7/00 220/636
3,394,832 A * 7/1968 McAllister ..... B65F 1/06 220/254.3
4,872,582 A 10/1989 Sipple
5,810,364 A 9/1998 Canion
5,897,018 A * 4/1999 Pruitt ..... B65F 1/141 220/603
7,762,418 B1 * 7/2010 Natale ..... B65F 1/02 220/23.87
8,286,925 B1 * 10/2012 White, Jr. ..... A47G 29/1216 248/156
9,010,562 B1 * 4/2015 Sparks ..... B65F 1/141 220/475
9,573,742 B1 2/2017 Schmid
10,349,770 B1 * 7/2019 Cougar ..... G07C 9/00912
2004/0094558 A1 5/2004 Najd
2007/0103297 A1 * 5/2007 Armstrong ..... A47G 29/1207 340/539.22
2013/0327775 A1 * 12/2013 Diaz ..... B65F 1/122 220/315
2014/0076912 A1 * 3/2014 Mattingly ..... B65F 1/1623 220/810

(Continued)

OTHER PUBLICATIONS

"Titan Tool Box", Home Depot, Model # TT-288000, https://www.homedepot.com/p/Titan-Tool-Box-32-in-Poly-Tool-Box-Storage-Chest-TT-288000/206381926, downloaded on and know about as early as Dec. 27, 2017, pp. 1-4.

*Primary Examiner* — William L Miller
(74) *Attorney, Agent, or Firm* — Kunzler Bean & Adamson

(57) ABSTRACT

A container for receiving package delivery is described. The container includes a base, a lid, and a weight component. The lid is coupled to the base. The weight component is sized to fit into the base. The weight component forms a tank to enclose a material and provide weight to the container. The weight component includes a recess and a port. The recess is defined in the weight component. The port is disposed within the recess to be interior to the base when the weight component is place within the base.

20 Claims, 4 Drawing Sheets

(56) References Cited

U.S. PATENT DOCUMENTS

| | | | | |
|---|---|---|---|---|
| 2014/0091100 | A1* | 4/2014 | Wan | B65F 1/1473<br>220/636 |
| 2019/0000255 | A1* | 1/2019 | Dehner | E05B 65/5246 |
| 2019/0077593 | A1* | 3/2019 | Gallo | B65F 1/141 |

* cited by examiner

PACKAGE CONTAINER

CROSS-REFERENCES TO RELATED APPLICATIONS

This application claims the benefit of U.S. Provisional Patent Application No. 62/622,369 entitled "PACKAGE CONTAINER" and filed on 26 Jan. 2018 for Ryan Rampton, which is incorporated herein by for all purposes. See MPEP § 213.

FIELD

This invention relates to containers and more particularly relates to package containers.

BACKGROUND

Delivery of packages is convenient and effective. Packages can be sent from anywhere in the world and arrive at any location around the world. Packages may range from inexpensive trinkets to high value items. While some delivery options are secure, not every delivery location or type provides a secure option.

SUMMARY

A container for receiving package delivery is described. The container includes a base, a lid, and a weight component. The lid is coupled to the base. The weight component is sized to fit into the base. The weight component forms a tank to enclose a material and provide weight to the container. The weight component includes a recess and a port. The recess is defined in the weight component. The port is disposed within the recess to be interior to the base when the weight component is place within the base.

A method of making a weighted package delivery container is also described. The method includes forming a base. The method also includes coupling a lid to the base. The method also includes forming a weight component sized to fit in the base. The weight component includes a port, disposed within a recess of the weight component, to be interior to the base. The weight component encloses a material and provides weight to the weighted package delivery container.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
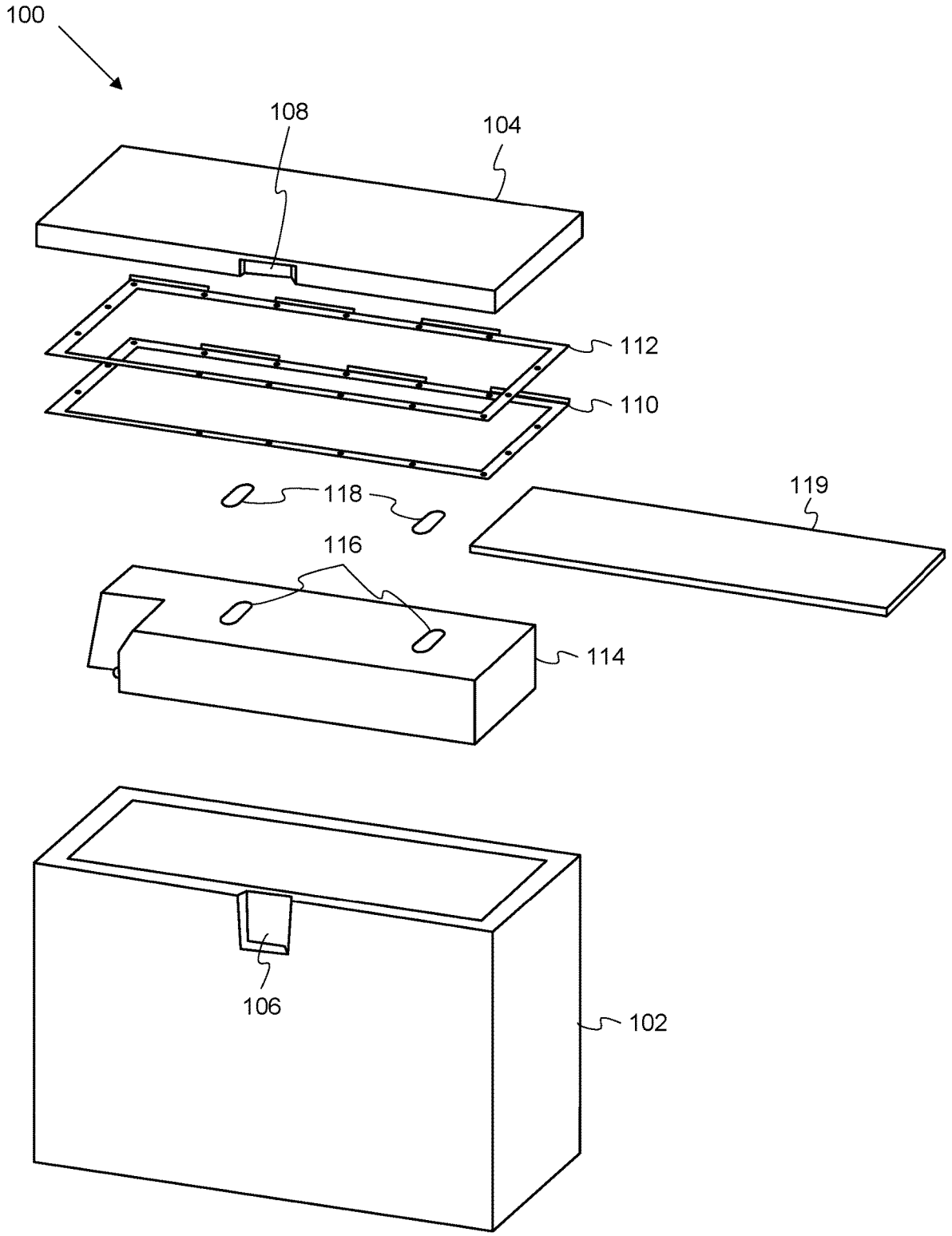
FIG. 1 is an exploded view of one embodiment of a container for receiving a package delivery.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

In the above description, certain terms may be used such as "up," "down," "upper," "lower," "upward," "downward," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of" or "one or more", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The flowcharts included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding blocks shown.

These features and advantages of the embodiments will become more fully apparent from the following description and appended claims, or may be learned by the practice of embodiments as set forth hereinafter. As will be appreciated by one skilled in the art, aspects of the present invention may be embodied as a system, apparatus, and/or method.

The schematic flowchart diagrams and/or schematic block diagrams in the Figures illustrate the architecture, functionality, and operation of possible implementations of apparatuses, systems, and methods according to various embodiments of the present invention. In this regard, each block in the schematic flowchart diagrams and/or schematic block diagrams may represent a module, segment, or portion of code, which comprises one or more executable instructions of the program code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware that perform the specified functions or acts.

Some of the embodiments described herein depict a package container that is theft-resistant. As used herein, the term "theft-resistant" describes a component or aspect of the container which introduces difficulty or requires additional effort to take possession of the container, gain access to the interior of the container, or take possession of the contents of the container. In some embodiments, the container has a weight component. The weight component may be a solid weight, a tank, bag, or other reservoir to increase the weight of the container.

The weight component includes a port through which the weight component may be drained and/or filled. In some embodiments, the port is positioned such that access from outside the container is restricted. This improves the tamper resistance of the container as the weight may not be reduced without first gaining access to an interior of the container and draining the weight component.

The container may also include a lock component. The lock component secures a state of an access point of the container. For example, the lock component may secure a lid or handle of the container. The state may be a closed or open state. The lock component may receive an input and perform a corresponding action (e.g. locking or unlocking). The lock component may be purely hardware, or a combination of software and hardware.

FIG. 1 is an exploded view illustrating one embodiment of a container 100. In the illustrated embodiment, the container 100 includes a base 102. In some embodiments, the base 102 forms a portion of the container 100. In the illustrated embodiment, the base 102 includes five sides of the container 100. The five sides of the base 102 may include a horizontal floor and a plurality of vertical walls. In the illustrated embodiment, the base 102 forms a rectangular cuboid with one pair of vertical walls being longer than another pair of vertical walls. While this specific geometry is illustrated, the base 102 may include other geometries. For example, the base 102 may form a portion of a cube, a cylinder, a pyramid, a sphere, or a combination or variation on these or other geometries.

In some embodiments, the base 102 is formed with blow-molded plastic. In other embodiments, the base 102 is formed with metals, composites, or other materials. In some embodiments, the base 102 is formed with a combination of different materials. In some embodiments, the base 102 is insulated. In some embodiments, the base 102 is armored to resist at least one of crushing, puncturing, drilling, cutting, tearing, and other forms of destructive actions.

In some embodiments, the base 102 is formed with a solid geometry. In other embodiments, some or all of the base 102 is formed with a hollow geometry. In some embodiments, a hollow geometry of the base 102 facilitates insertion of armor, fill, weight material, insulation, electronics, or other components.

In some embodiments, the base 102 includes a coating or treatment to at least one of an exterior and an interior of the base 102. For example, the base 102 may include waterproofing, reflective or anti-reflective, paint primer, radio wave blocking, anti-scratch, or other coatings, treatments, components, or features.

The illustrated embodiment of the container also includes a lid 104. In some embodiments, the lid 104 is made of the same or similar materials as the base 102. In other embodiments, the lid 104 comprises materials which are distinct or different from the base 102. In some embodiments, the lid 104 has the same or similar construction to that of the base 102. In other embodiments, the lid 104 has a distinct or different construction from that of the base 102. For example, the lid 104 may use a solid construction while the base 102 uses a wholly or partially hollow construction. The lid 104 and base 102 may share other similarities and distinctions.

In some embodiments, the lid 104 has a geometry that matches approximately flush with the base 102. In other embodiments, the lid 104 includes a lip which overhangs or interfaces with an edge of the base 102. In some embodiments, the lid 104 includes a hinge or other attachment system for coupling the lid 104 to the base 102. In other embodiments, the lid 104 is separate and uncoupled from the base 102. In some embodiments, the lid 104 includes a support structure such as a strut, spring, piston, hook, latch, rod, or the like to support the lid 104 in an open position. In some embodiments, the support structure is incorporated into a hinge or other component of the lid 104, the base 102, or another portion of the container 100.

In some embodiments, the container 100 includes a lock component 106. In the illustrated embodiment, the lock component 106 is coupled to the base 102. In other embodiments, the lock component 106 is coupled to another portion of the container 100 such as the lid 104. Alternatively, the lock component 106 may be removable from the container 100 and repositionable.

In some embodiments, the lock component 106 is integrated with a handle, latch, button, switch, or other interface structure for opening and closing the lid 104 relative to the base 102. In other embodiments, the lock component 106 is separate from but engages with the interface structure to allow or resist operation of the interface structure to open or close the lid 104 relative to the base 102. In some embodiments, the lock component 106 engages a single portion of the container 100 to resist opening or closing of the lid 104 relative to the base 102. In other embodiments, the lock component 106 engages at multiple points to resists opening or closing of the lid 104 relative to the base 102 of the container 100. In some embodiments, the lock component 106 includes multiple lock components 106 which may operate independently or cooperatively.

In some embodiments, the lock component 106 interfaces with a lock receiver 108 coupled to the lid 104. In some embodiments, the lock component 106, in conjunction with the lock receiver 108, facilitates securing of the lid 104 to the base 102. In some embodiments, the lock component 106 is at least one of unlocked and locked with one or more of a physical key, a biometric, a package identifier (such as a barcode, QR code, or the like, and a signal (such as code, radio, light, camera image, etc.). For example, the container 100 may be accessed by scanning a package to be delivered. Scanning the package may disarm the lock component 106 and allow access to the container 100.

In some embodiments, the lock component 106 includes a visual, tactile, or other display or identifier to indicate to a user how to operate the lock component 106 to lock the lock component 106, test the state of the lock component 106, or open the lock component 106 or lid 104. In some embodiments, the lock component 106 includes a battery or other power source (e.g. a power cord, capacitor, solar cell, generator, etc.). Alternatively, the battery or other power source may be located elsewhere in the container 100 or separate from the container 100.

In some embodiments, the lock component 106 may be connected to a network or respond to wired or wireless communications. For example, the lock component 106 may be capable of receiving and/or sending signals over Bluetooth®, wi-fi, or other radio or wireless modes of communication. In some embodiments, the lock component 106 or another component in communication with the lock component 106 receives an input and actuates the lock component 106 in response to satisfaction of a criteria. For example, a delivery service may scan a package, the package delivery is confirmed as an expected delivery, and the lock component 106 is actuated to allow the delivery service to secure the package within the container 100. Other validation scenarios are also contemplated.

In the illustrated embodiment, the container 100 includes a base rim 110 and a lid rim 112. In some embodiments, the base rim 110 extends around an edge of an opening in the base 102. The base rim 110 may be made of a metal, composite, plastic, wood, or other synthetic or natural material. In some embodiments, the base rim 110 provides a tamper-resistant and-wear resistant element for the base 102. In some embodiments, the base rim 110 provides additional closure (e.g. latching or magnetic) to secure lid 104 and close the container 100.

In some embodiments, at least one of the base rim 110 and the lid rim 122 provide a sealing function. In some embodiments, the sealing function resists entry of at least one of water, dust, and other contaminants, humans, animals, and insects.

In some embodiments, the base rim 110 interfaces with the lid rim 112. The base rim 110 may have a geometry and/or structure that matches or corresponds to a geometry and/or structure of the lid rim 112. In some embodiments, the lid rim 112 is identical in at least one of form, function, and material to the base rim 110. In some embodiments, at least one of the base rim 110 and the lid rim 112 interfaces or facilitates operation of at least one of the lock component 106 and the lock receiver 108.

In some embodiments, at least one of the base rim 110 and the lid rim 112 includes an attachment structure to couple the base 102 to the lid 104. For example, at least one of the base rim 110 and the lid rim 112 may include a hinge. In some embodiments, both the base rim 110 and the lid rim 112 include coupling structures to facilitate coupling of the base rim 110 to the base 102 and the lid rim 112 to the lid 104.

In the illustrated embodiment, the container 100 includes a weight component 114. In some embodiments, the weight component 114 is sized to fit into the base 102. In some embodiments, the weight component 114 rests on a bottom of the interior of the base 102 under the force of gravity. In some embodiments, the weight component 114 interfaces with a structure or portion of the base 102 to secure the weight component 114 relative to the base 102.

In some embodiments, the weight component 114 is separate from the structure of the base 102. In other words, in some embodiments, the weight component 114 may be removed from the base 102 without damage to the base 102. In other embodiments, the weight component 114 is integrated with the base 102. For example, the weight component 114 may be integrally formed as a part of the base 102 during manufacturing. In another example the weight component 114 may be permanently fixed to the base 102 via bonding, welding, heat staking, mechanical engagement, or other manners of fixing. In some embodiments, the weight component 114 is removable with the use of either general or specialized tools or hardware. In other embodiments, the weight component 114 is removable in response to entry of an access code or other corresponding information, signal, or trigger.

In some embodiments, the weight component 114 forms at least one of a solid weight, a tank, bag, or other reservoir. For example, the weight component 114 may include an enclosed tank to receive water, sand, or other material to increase a weight of the weight component 114 and, thereby, the base 102 and container 100.

In some embodiments, the weight component 114 is constructed, at least in part, of metal, plastic, composite, or other natural or synthetic materials. In some embodiments, the weight component 114 is constructed to resist tampering. For example, the weight component may include a material or structure that resists drilling, cutting, melting, crushing, embrittlement, or other invasive or destructive forces, processes, or actions.

In the illustrated embodiment, the weight component 114 includes two fill ports 116 with corresponding caps 118. While the illustrated embodiment depicts two fill ports 116 with corresponding caps 118, one or more than two fill ports 116 and corresponding caps 118 may be incorporated.

In some embodiments, the fill ports 116 facilitate filling of the weight component 114 with material to increase the weight of the weight component 114. For example, the fill ports 116 may be sized to receive a hose, funnel, bucket, bag, pouch, or other unit, transport system, or filling device to allow material to enter the weight component 114.

The caps 118 may be formed to engage with and close the fill ports 116. In some embodiments, the caps 118 form a relatively minimal disruption in the upper surface of the weight component 114 to minimize disruption or damage to packages placed into the container 100 to rest on the weight component 114. In some embodiments, the caps 118 are lockable and include a mechanical or magnetic engagement with the weight component 114 to secure the caps 118 within the fill ports 116 of the weight component 114. In some embodiments, the caps 118 are tamper-resistant. In some embodiments, the caps 118 resist prying, drilling, cutting, or other invasive or destructive forces or actions.

In the illustrated embodiment, the fill ports 116 are elongated in geometry. In other embodiments, the fill ports 116 are round, square, oval, triangular, or some other regular or irregular geometries. In the illustrated embodiment, the fill ports 116 are oriented parallel to one another. In other embodiments, the fill ports 116 are non-parallel. In the illustrated embodiment, the fill ports 16 are oriented perpendicular to a major dimension of the base 102 and lid 104. In other embodiments, the fill ports 116 may be oriented in a non-perpendicular arrangement relative to these elements. In some embodiments, the fill ports 116 are identical. In other embodiments, the fill ports 116 have geometries and/or orientations which are different from one another.

The illustrated embodiment includes an optional shelf 119. In some embodiments, the shelf 119 can be positioned on top of the weight component 114 to protect and disguise the structure of the weight component 114. In some embodiments, the shelf 119 rests on the weight component 114. In other embodiments, the shelf 119 interfaces with an internal structure of the base 102 to support the shelf 119 above the weight component 114. In some embodiments, the shelf 119 includes integrated or separate support structures to support the shelf 119 on at least one of the weight component 114, on the walls of the base 102, on an upper edge of the base 102, on a floor of the base 102, and suspended from the lid 104. The weight component 114 may be similarly supported. Other manners of supporting the shelf 119 and/or the weight component 114 may also apply.

In some embodiments, the shelf 119 is integrated with the caps 118. In some embodiments, the shelf 119 includes a handle or other structure to facilitate lifting the shelf 119 out of the base 102 to access the weight component 114. In some embodiments, the shelf 119 may lock or otherwise secure to the base 102 or weight component 114.

Figure 2:
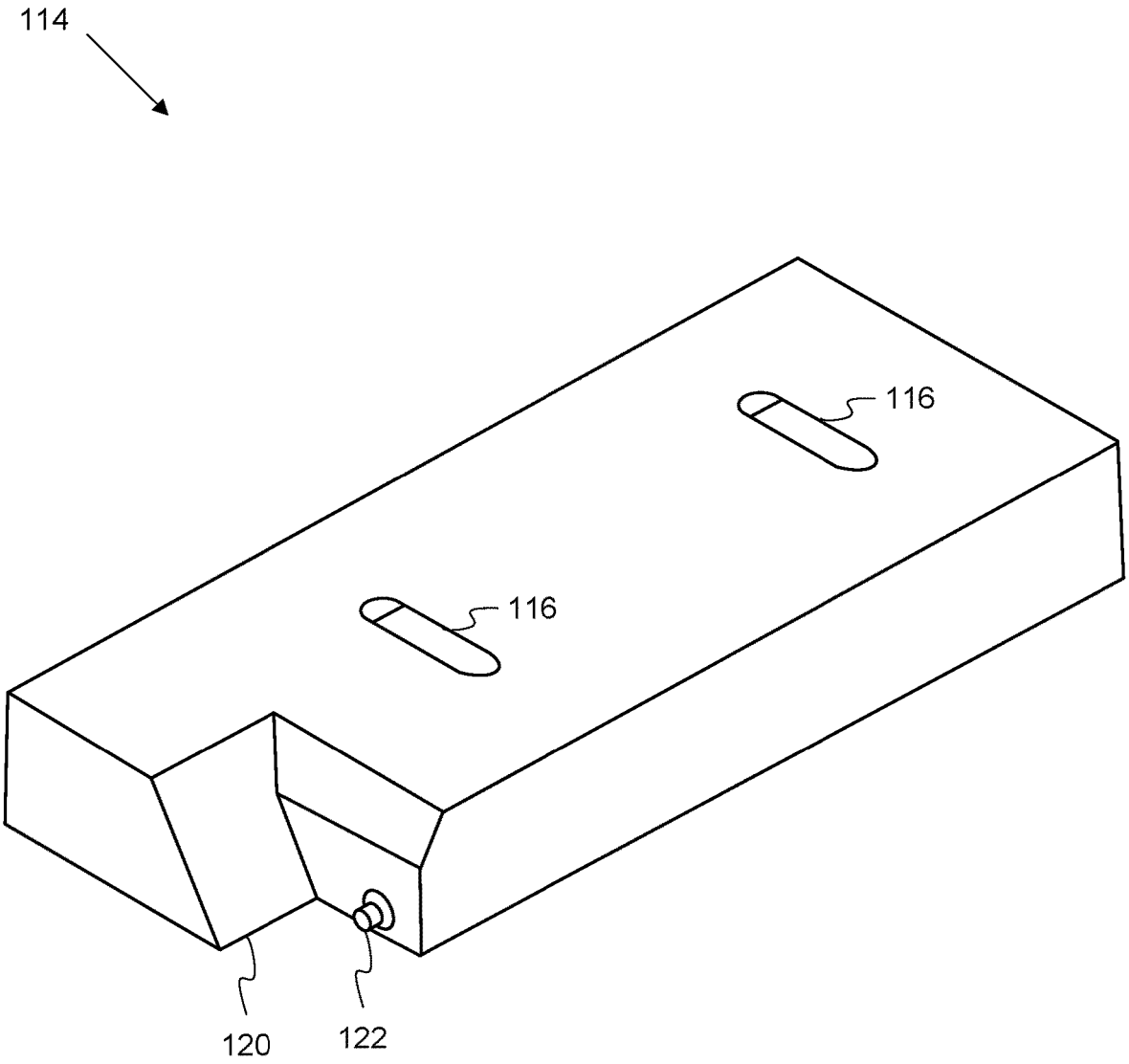
FIG. 2 is a perspective view of one embodiment of a weight component.

FIG. 2 is an isometric view illustrating one embodiment of the weight component 114 of FIG. 1. In the illustrated embodiment, the weight component 114 includes the fill ports 116 described above with respect to FIG. 1. In some embodiments, the fill ports 116 are sized and shaped to facilitate manipulation of the weight component 114. For example, the fill ports 116 may be shaped to accommodate a hand or tool to allow a user, installer, servicer, or other person to engage the fill ports 116 to lift or reposition the weight component 114.

In some embodiments, one or more of the surfaces or sides of the weight component 114 includes reinforcement. For example, an upper surface of the weight component 114 may be reinforced to prevent damage from packages impacting or resting upon the weight component 114. In another example, a lower surface of the weight component 114 may be reinforced to resist wear or improve stability of the weight component 114 within the base 102. In another example, one or more sidewalls of the weight component 114 may be armored or otherwise reinforced to prevent puncture or damage to the weight component 114.

In some embodiments, the weight component 114 includes reinforcement structures internal to the weight component 114. For example, the weight component 114 may include beams, rods, walls, dividers, webs, partitions, pillars, corrugations, posts, stringers, indentations, creases, channels, or other structures or features formed into, on, or within the weight component 114.

The illustrated embodiment includes a recess 120. In the illustrated embodiment, the recess 120 is a notch or cutaway in a corner of the weight component 114. In the illustrated embodiment, the recess 120 is an angular recess. In other embodiments, the recess 120 may have a more or less angular geometry. In some embodiments, the geometry of the recess 120 provides structural strength or rigidity to the weight component 114.

In some embodiments, the recess 120 includes a port 122. In some embodiments, the port 122 facilitates at least one of draining and filling material in the weight component 114. In some embodiments, the port 122 includes a valve, cap, or attachment structure for a valve or other mechanism to provide or limit access to the inside of the weight component 114. In some embodiments, the recess 120 provides space for the port 122 to remain internal to the base 102 (described above with reference to FIG. 1) to avoid tampering or other accidental, malicious, or undesired operation of the port 122.

In some embodiments, the port 122 is located near an underside of the weight component 114 to facilitate complete drainage and/or reduce risk of damage or interaction from packages or other items placed on top of the weight component 114. In some embodiments, the recess 120 is sized to allow manipulation or operation of a valve or other mechanism or tool at the port 122. In some embodiments, by positioning the port 122 in the recess 120, the weight component 114 has increased resistance to tampering or unintended evacuation of material from within the weight component 114. In some embodiments, the port 122 is sized to correspond to a material contained within the weight component 114.

In the illustrated embodiment, the port 122 is shown as disposed at a particular location within the recess 120 of the weight component 114. In other embodiments, the port 122 is disposed at other locations within the recess 120. In the illustrated embodiment, the port 122 is shown as aligned perpendicular to the surface in which it is disposed. In other embodiments, the port 122 may be aligned at some non-perpendicular orientation relative to the surface in which it is disposed. In the illustrated embodiment, a single port 122 is shown within a single recess 120. Other embodiments include more than one port 122 disposed within one or more recesses 120. For example, the weight component 114 may include multiple separate or divided compartments or sections and one or more ports 122 may correspond to one or more of the compartments or sections within the weight component 114.

Figure 3:
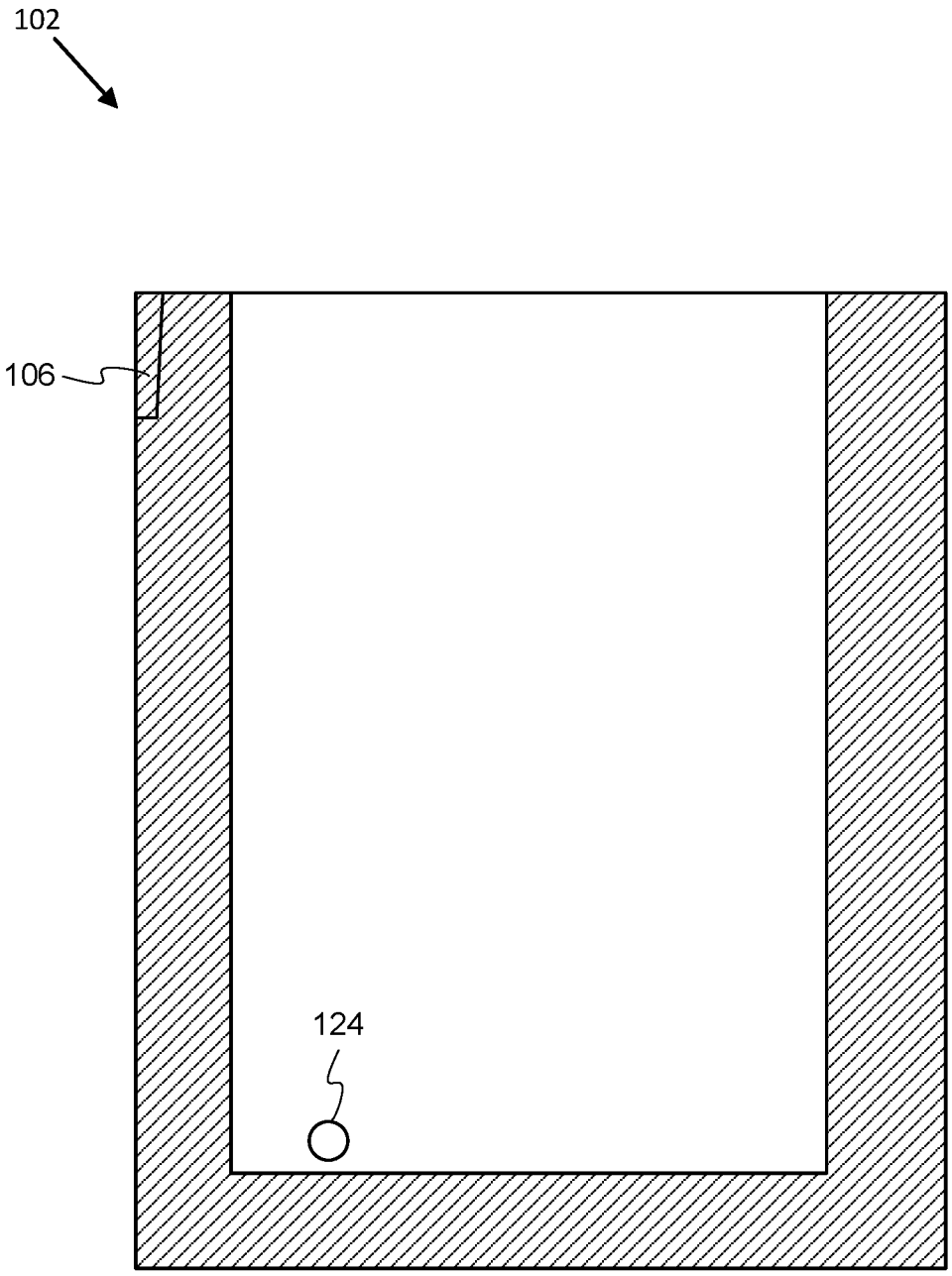
FIG. 3 is a cross-section view of one embodiment of a body of the package container of FIG. 1.

FIG. 3 is a cross-sectional view illustrating one embodiment of the base 102 of FIG. 1. In the illustrated embodiment, the base 102 includes an aperture 124. In some embodiments, the aperture 124 is, at least partially, aligned with the port 122 of the weight component 114 as shown and described in FIGS. 1 and 2. In some embodiments, the aperture 124 is sized to allow entry of a tool into the base 102. In some embodiments, the apertures 124 is sized to allow exit of a material from the base 102. For example, if a material is spilled from or drained from the weight component 114, it may escape the base 102 via the aperture 124. In another example, if a package within the base 102 leaks or if weather, such as rain, penetrates the interior of the container 100, the aperture 124 may allow for escape or drainage from the base 102.

In some embodiments, the aperture 124 includes a corresponding cap, screen, shield, filter or other structure to prevent unwanted entry into the base 102. In some embodiments, the aperture 124 is sized or includes structure to prevent entry of animals, insects, or other creatures as well as dust, water, cold or hot air, or other contaminants.

In some embodiments, the aperture 124 is positioned near a corner of the base 102. In other embodiments, the aperture 124 is position at other locations on the base 102. In the illustrated embodiment, the aperture 124 is positioned to be relatively near a side of the base 102 which corresponds to the lock component 106. In some embodiments, access to the aperture 124 may be controlled similar to embodiments of the lock component 106 described above. For example, access through the aperture 124 may be contingent upon reception of a correct key, code, signal, tool, or other instrument.

While the illustrated embodiment depicts a single aperture 124, other embodiments include a plurality of apertures 124 disposed in the base 102. In some embodiments, the aperture 124 corresponds to a compartment of a plurality of compartments within the base 102. In some embodiments, the aperture 124 is sized and/or positioned based on a material contained by the weight component 114. In some embodiments, the aperture 124 is sized and/or positioned to allow a fluid line to pass through the base 102 and connect to the weight component 114. While, in some embodiments, the aperture 124 is at least partially aligned with the port 122 of the weight component 114, in other embodiments, the aperture 124 is offset from the port 122 of the weight component 114 to further resist tampering.

Figure 4:
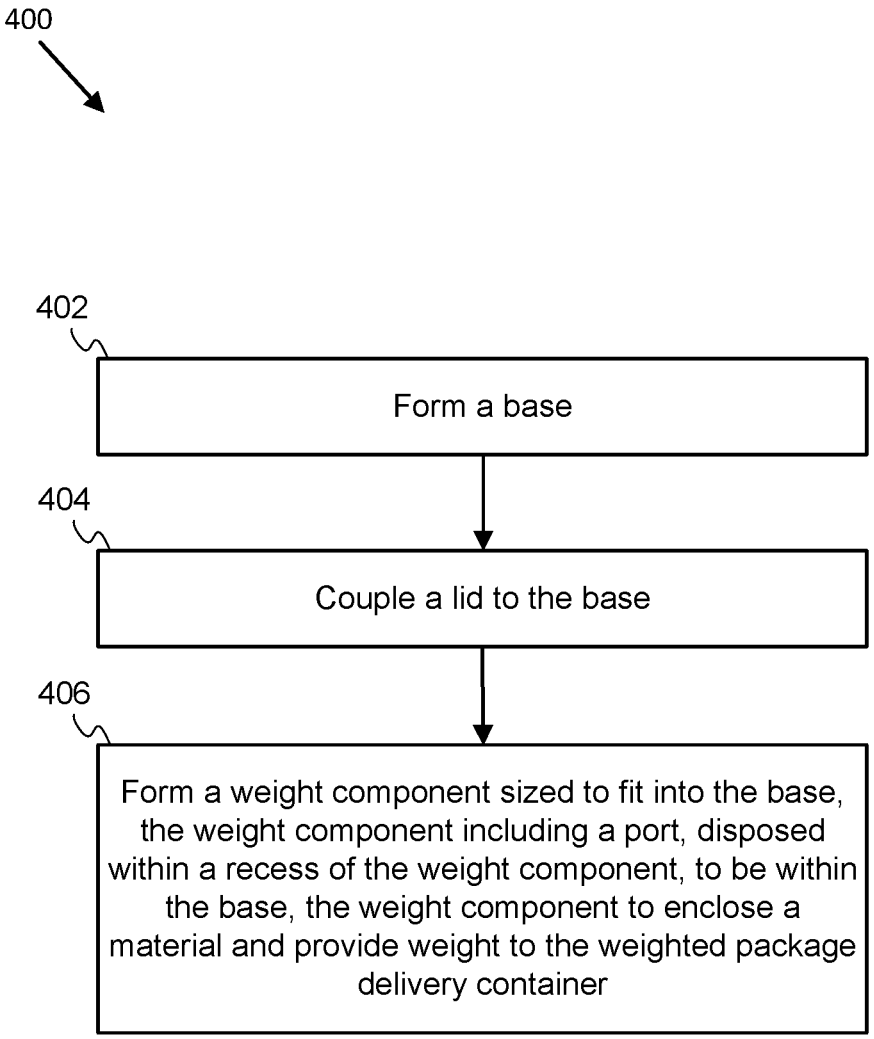
FIG. 4 is a method of making a weighted package delivery container.

FIG. 4 illustrates a flowchart of one embodiment of a method 400 for making a weighted package delivery container. In the illustrated embodiment, the method 400 includes, at block 402, forming a base 102. As described above, the base 102 may be formed by blow-molding a plastic or other material. The base 102 may also be formed by injection molding, vacuum molding, machining, bonding, or the like. The base 102 may include a single material or a combination of one of more natural and synthetic materials. In some embodiments, the base 102 includes armor or some other damage resistant component.

In the illustrated embodiment, the method 400 also includes, at block 404, coupling a lid 104 to the base 102. In some embodiments, the lid 104 is coupled to the base 102 via hardware such as a hinge, rims 110 and 112, or the like. In some embodiments, the lid 102 is coupled to the base via a lock component 106 or other locking or securing component.

The illustrated embodiment of the method 400 also includes, at block 406, forming a weight component 114 sized to fit into the base 102. The weight component 114 includes a port 122, disposed within a recess 120 of the weight component 114, to be within the base 102. The weight component 114 encloses a material and provides weight to the weighted package delivery container 100. In some embodiments, the material comprises water, sand, or other material capable of being contained by the weight component 114 and contribute weight to the weight component 114 and the container 100. In some embodiments, the port 122 is capable of providing a pathway for the material relative to the weight component 114.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A container for receiving package delivery, the container comprising:
   a base;
   a lid coupled to the base; and
   a weight component sized to fit into the base, the weight component forming a tank to enclose a material and provide weight to the container, the weight component comprising:
      a recess defined in the weight component; and
      a port, disposed within the recess, to be interior to the base when the weight component is placed within the base and provide access to an interior of the weight component.

2. The container of claim 1, further comprising a lock component to secure the lid to the base.

3. The container of claim 2, wherein the lock component is operated in response to at least one of a key, a biometric scan, a digital signal, and a package identifier.

4. The container of claim 2, wherein the lock component is at least partially recessed within at least one of the base or the lid.

5. The container of claim 1, wherein at least one of the base or the lid comprises a corresponding rim.

6. The container of claim 1, wherein the weight component is separate from the base.

7. The container of claim 1, wherein the weight component is integrated with the base.

8. The container of claim 1, wherein the port provides access to the interior of the weight component proximate a bottom surface of the weight component.

9. The container of claim 1, further comprising at least one shelf disposed within the base.

10. The container of claim 1, wherein the material is a fluid.

11. The container of claim 1, further comprising at least one fill port disposed in the weight component to provide access to the interior of the weight component.

12. The container of claim 11, further comprising at least one cap corresponding to the at least one fill port, the at least one cap shaped to close the at least one fill port to block access to the interior of the weight component.

13. The container of claim 1, wherein at least one of the base and the lid are insulated.

14. A method of making a weighted package delivery container, the method comprising:
   forming a base;
   coupling a lid to the base; and
   forming a weight component sized to fit into the base, the weight component comprising a port, disposed within a recess of the weight component, to be interior to the base and to provide access to an interior of the weight component, the weight component to enclose a material and provide weight to the weighted package delivery container.

15. The method of claim 14, wherein forming the base comprising blow molding.

16. The method of claim 14, wherein forming the weight component comprises disposing at least one fill port in the weight component to provide access to an interior of the weight component.

17. The method of claim 16, further comprising disposing at least one cap corresponding to the at least one fill port, the at least one cap being shaped to close the at least one fill port.

18. The method of claim 14, wherein forming the base comprising disposing at least one of insulation or armor in the base.

19. The method of claim 14, wherein coupling the lid to the base comprises disposing at least one of waterproofing or tamper resistant materials.

20. The method of claim 14, further comprising disposing at least one shelf within the base.

* * * * *